United States Patent [19]

Stout et al.

[11] 3,998,176

[45] Dec. 21, 1976

[54] HYDRO-SKI CRAFT

[75] Inventors: Ernest G. Stout, Glendale; Francis L. Thornburg, Canoga Park, both of Calif.

[73] Assignee: Lockheed Aircraft Corporation, Burbank, Calif.

[22] Filed: Feb. 18, 1975

[21] Appl. No.: 550,565

[52] U.S. Cl. ..... 114/283; 114/61

[51] Int. Cl.[2] ..... B63B 1/18

[58] Field of Search ..... 114/66.5 R, 66.5 F, 114/66.5 H, 66.5 P, 61; 115/70; 244/105, 108

[56] References Cited

UNITED STATES PATENTS

| | | | |
|---|---|---|---|
| 3,308,780 | 3/1967 | Abramson | 114/66.5 P |
| 3,469,550 | 9/1969 | Priestley | 114/66.5 H |
| 3,695,204 | 11/1972 | Bennett | 114/66.5 P |
| 3,702,106 | 11/1972 | Wilder | 114/123 |

*Primary Examiner*—Trygve M. Blix
*Assistant Examiner*—Sherman D. Basinger
*Attorney, Agent, or Firm*—Billy G. Corber; Lowell G. Turner

[57] ABSTRACT

A ski-type water borne craft adapted to plane along the surface of a body of water and having two stabilizing elements spaced laterally apart and mounted for upward and downward movement relative to one another in a relationship providing roll forces and giving lateral stability to the craft, with the stabilizing elements preferably being a pair of swinging flaps hinged to the after ends of two vertically shiftable hydroskis.

21 Claims, 15 Drawing Figures

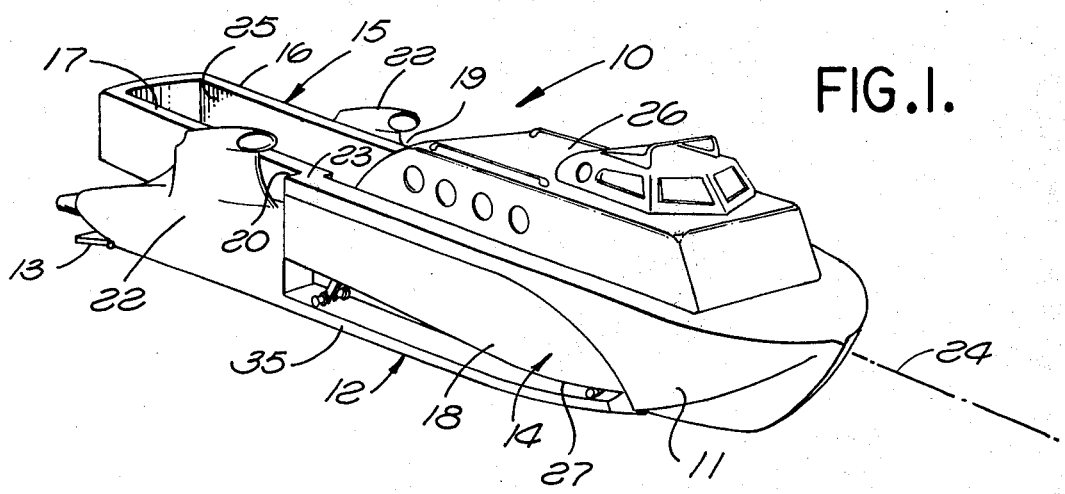
FIG.1.
FIG.2.
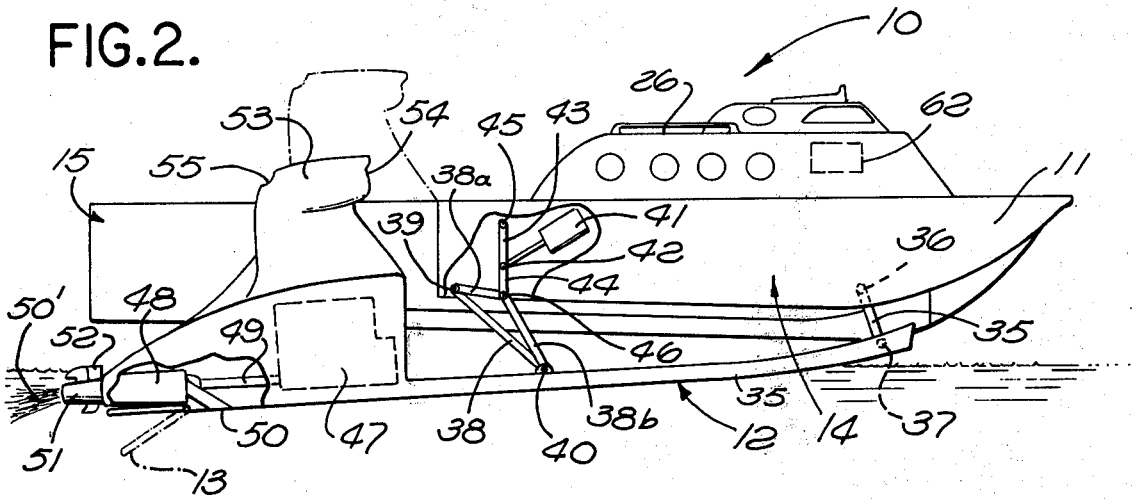
FIG.3.
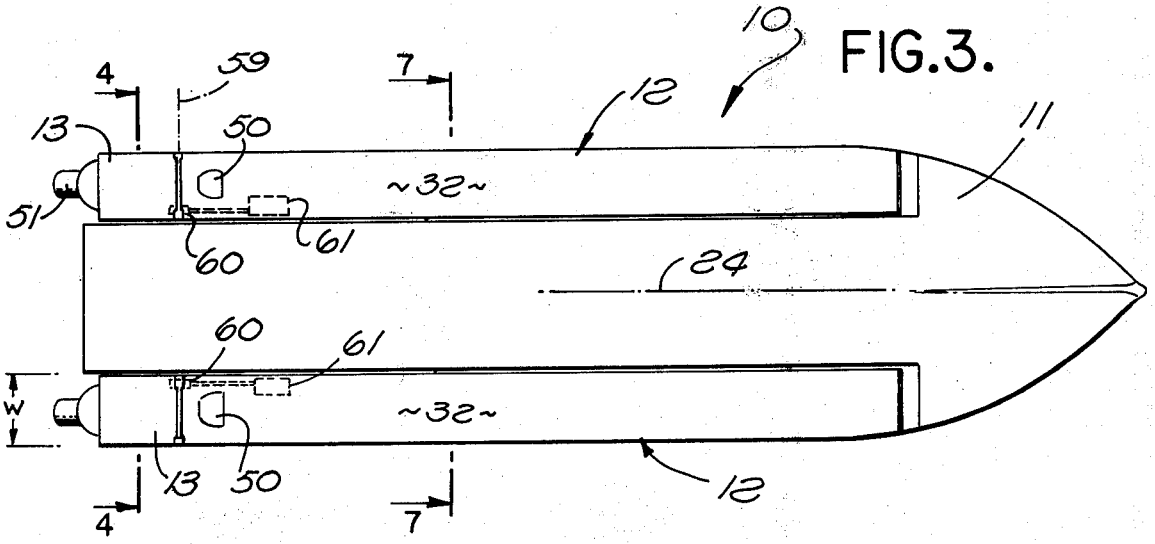

FIG.4.
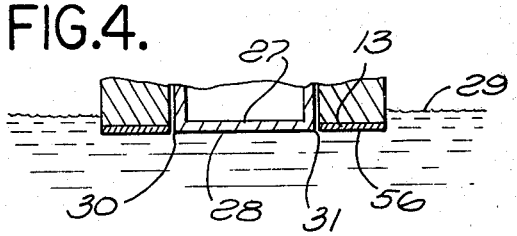
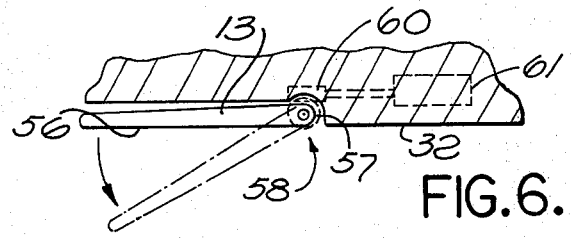
FIG.6.
FIG.5.
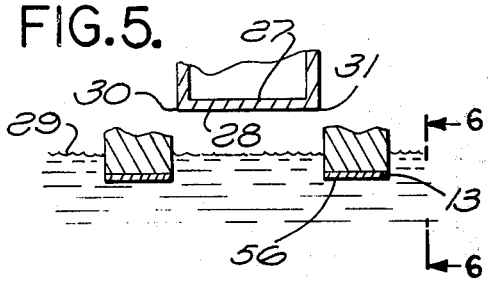
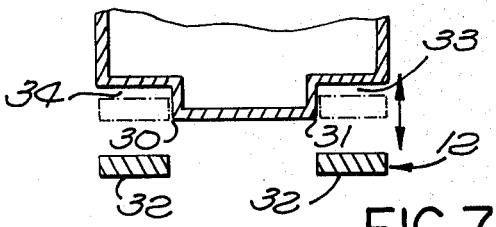
FIG.7.
FIG.8.
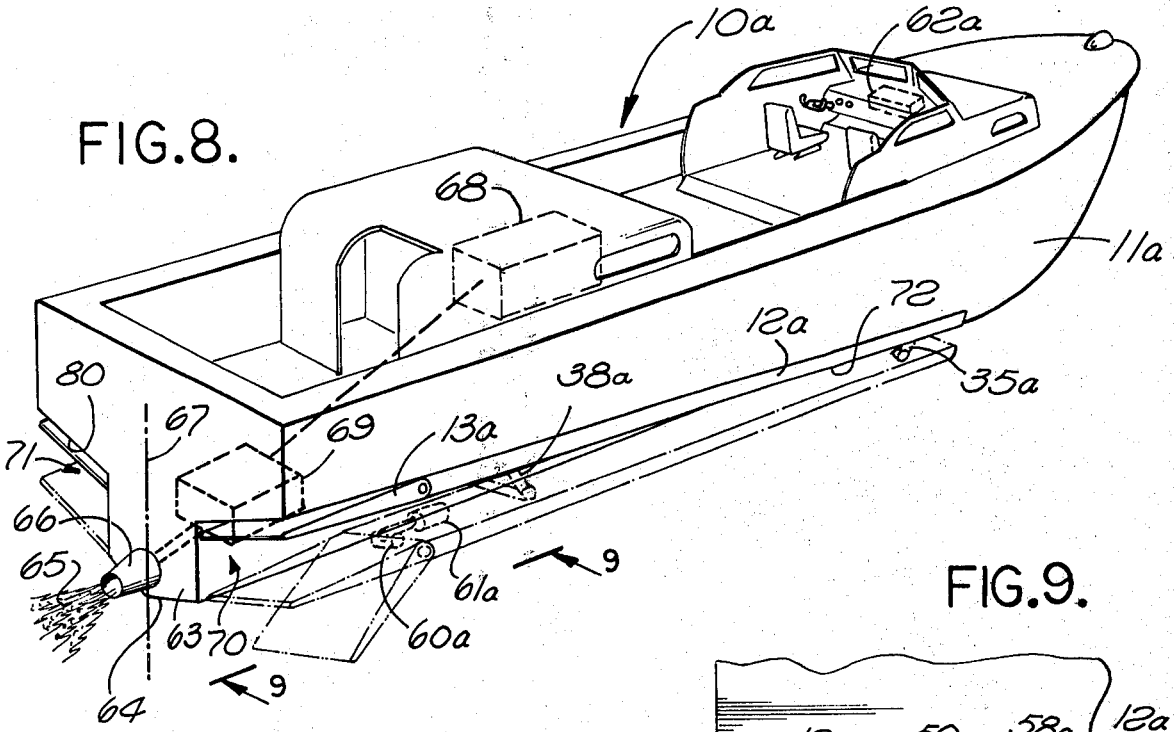
FIG.9.
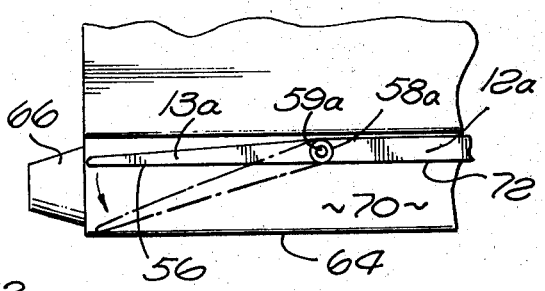
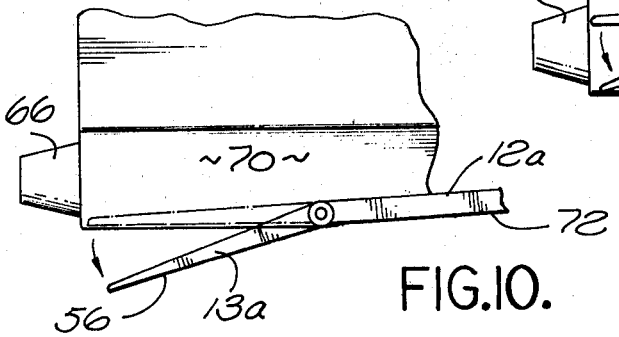
FIG.10.

FIG.11.
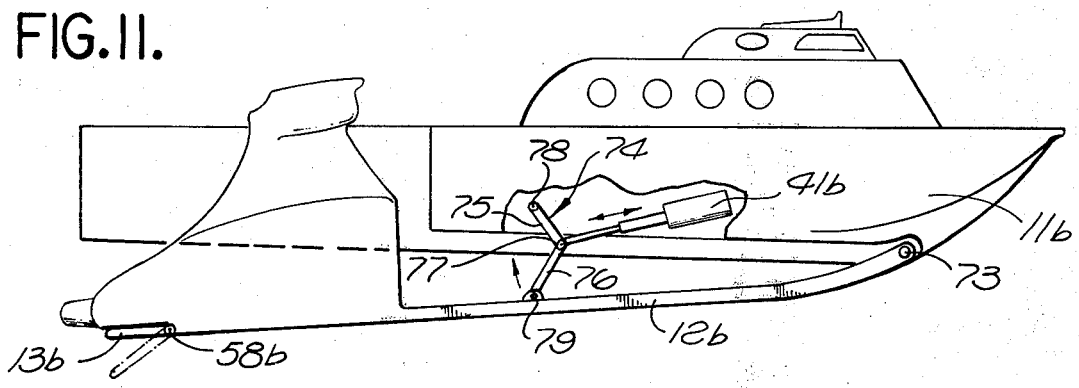
FIG.12.
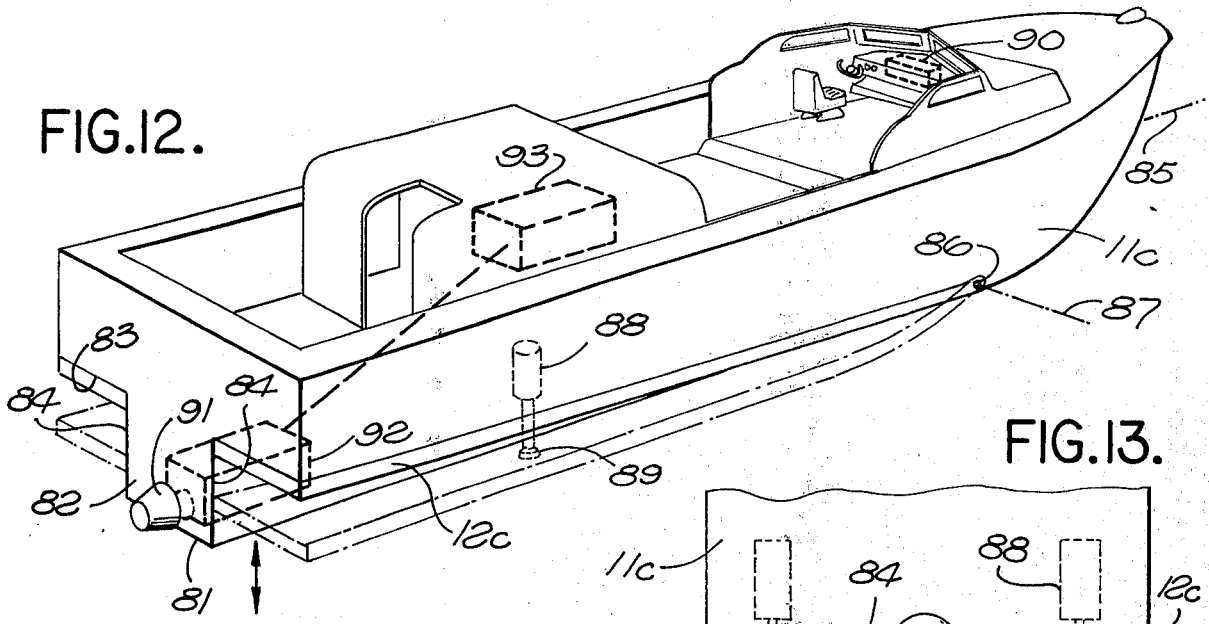
FIG.13.
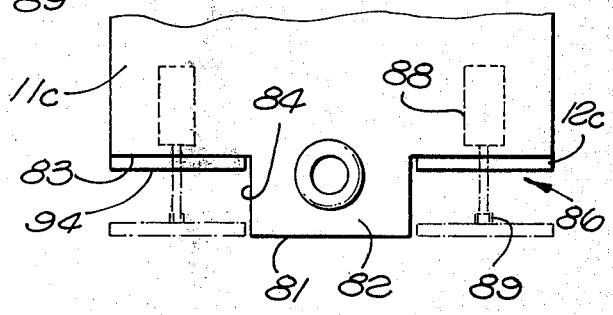
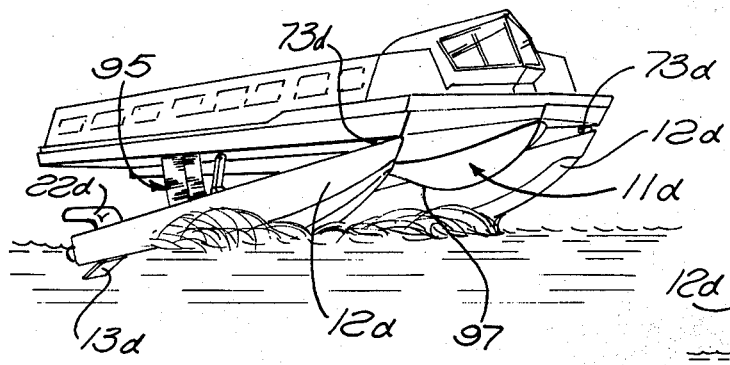
FIG.14.
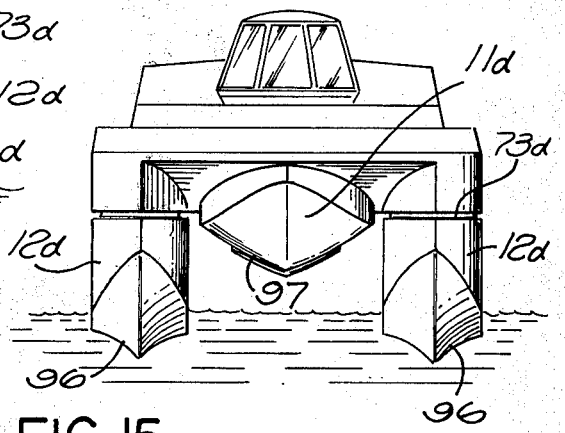
FIG.15.

HYDRO-SKI CRAFT

BACKGROUND OF THE INVENTION

This invention relates to improved hydro-ski type water borne craft in which lift is attained at high speed by a planing action of the craft along the surface of a body of water.

When a boat having a planing hull reaches a relatively high speed in traveling over the surface of the water, it becomes highly susceptible to overturning or damage by the action of waves which may be present on the water surface. The higher the speed, the greater the danger involved in contact with even very small waves which at slow speeds would be negligible and unnoticed. In order to reduce this adverse effect at high speed, and to attain an increased percentage of load alleviation at such speeds, boats have been designed in which skis movably carried by the hull of the craft have been adjustable upwardly and downwardly relative to the hull in a relationship controllably varying the total amount of planing surface which is properly positioned for contact with the water at different speeds. One such arrangement is shown in U.S. Pat. No. 3,308,780 issued Mar. 14, 1967.

In the type of boat shown in that patent, two skis at opposite sides of a hull coact with a planing undersurface of the hull to support the boat when the skis are in upwardly retracted positions, but act to support the boat independently of any contact of the hull surface with water when the skis are actuated downwardly to high speed extended positions. Thus, the area of contact with the water is greatly reduced at high speeds, and the resultant disruptive effect which can be produced by a wave of a particular size is similarly decreased.

One problem which is encountered in hydro-ski craft is that of maintaining lateral stability of the boat in a relation preventing and counteracting roll movements and maintaining a properly horizontal orientation of the craft. In the arrangements of U.S. Pat. No. 3,149,600 maintenance of lateral stability is attained by controlled manipulation of vectored jets which drive the craft. These vectored jets, however, require undue complexity of construction and actuation, and are difficult for a person to control without a considerable amount of special training. The problem of instability against roll has been even more critical in craft of the "mono-ski" type in which at high speed only a single planing surface, rather than two such surfaces, contacts and planes along the water.

SUMMARY OF THE INVENTION

A major purpose of the present invention is to provide for improved lateral stability in a hydro-ski boat, so that an operator may at all times have very effective and precise control over any forces which may be encountered tending to roll the boat toward one side or the other. The control apparatus provided for this purpose is extremely simple in structure and operation, and yet very rugged and positive in action, and rapid in response, to function reliably over long periods of use and under adverse conditions.

To attain such control, we provide in a hydro-ski craft a pair of stabilizing elements which are mounted for upward and downward movement relative to the hull of the craft, and relative to one another, to produce controllable roll forces for maintaining lateral stability of the craft. In one form of the invention, a pair of skis themselves may function as these stabilizing elements. In other forms, the stabilizing elements may be flaps mounted to a pair of skis for movement both with and relative to the skis. The flaps may be mounted to the skis by simple hinges connecting forward edges of the flaps to trailing ends of the skis and mounting the flaps to swing relative to the skis about axes extending generally transversely of the direction of travel of the boat. The flaps or other stabilizing elements may be operated differentially, so that one moves down when the other moves up, with the result that the roll counteracting torque exerted by the two elements in any particular setting is in the same direction.

Additional features of the invention relate to a unique hydro-ski arrangement in which a pair of skis are at high speeds retractable upwardly to a level substantially higher than a planing undersurface of the hull, in a relation leaving that hull surface as a single central planing surface at such high speeds. When upwardly retractable skis of this type are utilized, the problem of maintaining lateral stability of the boat traveling at high speed on the single central planing surface is maximized, and the advantages attained by the above discussed stabilizing arrangement become extremely important. When the skis are in their upwardly retracted positions, downward actuation of only one of skis, or a flap carried by one of the skis, moves that ski or flap into contact with the surface of the water, or into contact with spray from the water, to exert any desired amount of upward force against the ski or flap, and thus controllably maintain lateral stability as discussed.

BRIEF DESCRIPTION OF THE DRAWINGS

The above and other features and objects of the invention will be better understood from the following detailed description of the typical embodiments illustrated in the accompanying drawings in which:

FIG. 1 is a perspective view of a first form of hydro-ski craft embodying the invention and having lateral control flaps, the craft being shown with the skis in a downward or planing mode;

FIG. 2 is a side view of the FIG. 1 craft;

FIG. 3 is a bottom view of the FIG. 1 craft;

FIG. 4 is a somewhat schematic, fragmentary vertical section taken on line 4—4 of FIG. 3, and with the skis retracted;

FIG. 5 is a view similar to FIG. 4, but showing the skis in their lowered or extended position;

FIG. 6 is enlarged fragmentary side view taken on line 6—6 of FIG. 5, and showing one of the lateral control flaps;

FIG. 7 is a fragmentary vertical section taken on line 7—7 of FIG. 3;

FIG. 8 is a perspective representation of another craft of the "monoski" type, embodying the invention;

FIG. 9 is an enlarged fragmentary side view taken on line 9—9 of FIG. 8;

FIG. 10 is a view similar to FIG. 9, but showing one of the skis in its lowered position;

FIG. 11 is a view similar to FIG. 2, but showing a variational type of ski mount;

FIG. 12 is a view similar to FIG. 8, but showing another variational arrangement;

FIG. 13 is a rear view of the FIG. 12 craft;

FIG. 14 is a perspective view of another form of the invention in which the skis take the form of buoyant pontoons which are shown in a downward or planing mode; and FIG. 15 is a reduced front view of the FIG. 14 boat.

DESCRIPTION OF THE PREFERRED EMBODIMENTS

FIGS. 1 to 7 show the adaption of the present invention to a hydro-ski craft 10 of essentially the type disclosed in U.S. Pat. No. 3,308,780. This boat 10 includes a hull 11 which carries at its opposite sides a pair of skis 12 mounted for upward and downward shifting movement in unison between a retracted position and an extended position. In accordance with the teachings of the invention, these skis 12 carry near their after ends two lateral control flaps 13 which are adapted to swing downwardly and upwardly relative to the skis.

The hull 11 has a forward relatively wide portion 14 and a rear narrower portion 15 having two parallel vertical opposite side walls 16 and 17 which are spaced laterally inwardly relative to the opposite sides 18 of the forward portion of the hull in a manner forming two recesses 19 and 20 within which a pair of power plants 22 carried by the two skis 12 are received. The fronts of these recesses may be defined by a pair of transverse vertical bulkheads 23 perpendicular to the longitudinal front to rear axis 24 of the craft. As will be apparent, walls 16 and 17 define opposite sides of a passenger or cargo space 25, which leads forwardly into a cabin within portion 26 of the hull.

As best seen in FIGS. 4, 5 and 7, the bottom wall 27 of the hull is shaped to have a planing undersurface 28, which may be substantially planar as shown, and which is adapted to contact the upper surface of a body of water 29 and plane therealong. This planing undersurface 28 terminates laterally at the locations 30 and 31 of FIGS. 4, 5 and 7, directly adjacent the inner sides of the skis 12. The undersurfaces 32 of the skis form additional planing surfaces, which may also be substantially planar and which form in effect lateral continuations of the planing undersurface 28 of the hull in the upwardly retracted position of FIG. 4. Thus, when the skis are in their upwardly retracted positions, the hull and skis together form a relatively wide composite planing surface extending across the entire undersurface of the boat, and extending along most of its length, to function in that condition essentially as a conventional planing hull. In order to allow such upward retraction of the portions of the skis which are located forwardly of transverse bulkheads 23, the forward wider portion 14 of hull 11 has its bottom wall 27 recessed upwardly along its opposite sides, as indicated at 33 in FIG. 7, to form elongated recesses 34 into which the thin forward portions 35 of the skis are movable, to the broken line positions of FIG. 7.

The skis are mounted for their upward and downward shifting movement by any suitable mechanism, which may be a modified parallelogram arrangement as illustrated in FIG. 2 including, in association with each of the skis, a forward relatively short rigid strut 35 pivoted at 36 to the hull at 37 to the ski, and a rear longer strut 38 pivoted at 39 to the hull and at 40 to the ski. To power actuate the skis upwardly and downwardly, a hydraulically or pneumatically operated piston and cylinder mechanism 41 may have its piston rod connected to a knee joint pivotal connection 42 between a pair of links 43 and 44, whose second ends are pivotally connected respectively to the hull at 45 and links 38*a* and 38*b* at 46, so that powered retraction of the piston rod of mechanism 41 into its cylinder will swing the corresponding ski upwardly and forwardly to its retracted position.

The power plant 22 associated with each of the skis is contained within a relatively large housing projecting upwardly above the level of the rearward thin portion 35 of the ski, with this housing containing an engine 47 which typically drives a water jet pump 48 through a drive shaft 49. Pump 48 takes suction from the underside of the ski through a water inlet 50, and discharges the water as a high velocity jet stream 50′ emitting rearwardly from a jet nozzle 51, in a relation producing rapid forward motion of the boat through the water. Appropriate control mechanism diagrammatically represented at 52, and adapted to be controlled from the pilothouse of the boat, may controllably vector or aim the jets in any of different directions to steer or assist in steering the craft by the action of these jets. The top portion 53 of the power plants may contain air inlet and outlet openings 54 and 55 for delivering combustion air to engines 47.

The lateral control flaps 13, with which the present invention is particularly concerned, are mounted to the undersides of skis 12 near their after ends, and desirably rearwardly of the water intake or suction openings 50 of propulsion pumps 48. As seen in FIG. 3, these flaps 13 may be substantially rectangular in horizontal section, being of a width *w* corresponding to the lateral width of the planing surfaces 32 of the skis themselves, so that in the uppermost positions of the flaps (full lines in FIG. 6) the flat undersurfaces 56 of flaps 13 are coplanar with the planing undersurfaces 32 of the skis themselves, to form continuations of those ski surfaces. The flaps 13 are hinged to skis 12 for upward and downward swinging movement between the full line and broken line positions of FIG. 6. To allow this movement, the forward edge 57 of each flap 13 is connected by a hinge 58 to the corresponding ski, with that hinge and its axis 59 extending horizontally and directly transversely of the front to rear longitudinal axis 24 of the boat. A single axis 59 is of course common to both of the flaps 13 at opposite sides of the craft. Appropriate means are provided for power actuating each of the flaps 13 between its different positions, as for instance by a right angle gear drive represented diagrammatically at 60 in FIGS. 3 and 6, with this drive being energized by a suitable motor 61 which may be carried by the ski for movement therewith and be operated remotely and electrically, or otherwise, by a control represented diagrammatically at 62 in FIG. 2 and positioned for actuation at the piloting and steering station of the vessel. Control 62 desirably includes separate controls for the two flaps 13, so that each may be operated individually, and preferably also includes a common control which can operate the two flaps differentially, so that one flap is moved upwardly while the other is moved downwardly, and vice versa.

To now describe the operation of the boat of FIGS. 1 to 7, assume first of all that the craft is at a standstill, and that the skis 12 are retracted to their uppermost positions as shown in FIG. 4 and in broken lines in FIG. 7. With the skis in this condition, and with flaps 13 in their uppermost full line positions of FIG. 6, a large composite planing surface is formed at the bottom of the boat, including the undersurface 28 of the hull, the undersurfaces 32 of the skis, and the undersurfaces 56 of flaps 13.

When the pilot of the boat turns engines 47 on and commences operation of pumps 48 to produce jets 50', these jets induce forward motion of the boat through the water, with the craft first being supported solely as a displacement vessel, and then at a somewhat increased speed commencing to travel as a planing craft. In this condition, the discussed composite planing undersurface of the craft engages and planes along the upper surface of the body of water 29, giving lift to the vehicle by virtue of the planing action and thereby raising it from its initial displacement condition with respect to the water. This decreases the wetted area at the underside of the boat and the resultant drag and attains substantial initial load alleviation. When the craft reaches a predetermined speed, the pilot actuates the two skis 12 downwardly in unison, by delivering hydraulic or pneumatic pressure to their cylinders 41 simultaneously. The skis 12 are thus forced downwardly to the full line positions of FIGS. 2 and 7, and the position of FIG. 5, in which position the planing undersurfaces 32 still contact the surface of the water and plane therealong, but with the hull 11 being raised upwardly relative to the skis to a level at which the hull no longer contacts the surface of the water (FIG. 2). The wetted area of the hull is thus further drastically reduced, resulting in a reduction in drag and further alleviation of the load, for maximum efficiency of operation. The decreased area of contact with the water renders the overall boat much less susceptible to damage by wave impacts, and produces a very smooth ride.

If for any reason the boat tends to list or roll to one side or the other, the operator can counteract this rolling effect by actuating the corresponding one of the lateral control flaps 13 downwardly, as to its broken line position of FIG. 6 or an appropriate intermediate position. When thus directed downwardly, the flap 13 contacts the upper surface of the water at an increased angle and tends to cause that flap and the connected ski to move upwardly relative to the water. A roll in the opposite direction can similarly be counteracted by downward deflection of the other flap 13 to an appropriate inclined position. By adjusting the two flaps 13, the pilot can thus trim the craft to always maintain an appropriate horizontal altitude about longitudinal axis 24. If the common differential control for these two flaps 13 is employed, the downward movement of one flap will accomplish the same end result as the simultaneous upward movement of the other flap, so that the effects are additive and an extremely precise response can be attained. Also, automatic control of the flaps may be utilized if desired, to automatically compensate for any roll effect which may be encountered.

The flaps 13 may also be employed when the skis are in their upper retracted positions, to provide lateral control at the slower speeds at which the composite hull and ski planing surfaces are employed together. In that condition, downward deflection of either of the flaps will again tend to produce a rolling force for counteracting any abnormal force which may be produced by wave or wind action, or by turning effects or the like, to maintain the same lateral stability which has been discussed in connection with the high speed ski type operation.

FIG. 8 illustrates another hydro-ski craft 10*a* which embodies the invention but in which the power means for driving the vessel are not carried by the skis themselves. In FIG. 8, hull 11*a* is shaped at its underside to have a central mono-ski portion 63 having a downwardly facing undersurface 64 which functions as a planing surface at high speed to skim along the upper surface of a body of water and support the craft thereon. The vessel is propelled by a single jet of water 65 emitting from a nozzle 66 at high velocity, with that nozzle being vectored for swinging movement about a vertical axis 67 or otherwise to aim the jet in any of different directions for controlling the direction in which the vessel travels. An engine represented diagrammatically at 68 in FIG. 8 drives a water pump represented at 69 to produce the high velocity water jet, with the water intake to pump 69 being in communication with the water through the underside of the narrow mono-ski portion 63 of the hull.

At opposite sides of its mono-ski portion 63, the hull is shaped to form two recesses 70 and 71 extending along the oppposite sides of the hull. Within these recesses, there are mounted a pair of skis 12*a*, which are appropriately mounted by struts 35*a* and 38*a* corresponding to elements 35 and 38 of FIG. 2, or otherwise, for downward and upward bodily swinging movement between the full line upwardly retracted positions of FIG. 8 and the broken line downwardly extended positions. In the broken line positions, the essentially planar undersurfaces 72 of skis 12*a* are coplanar with and aligned with the adjacent portions of undersurface 64 of the mono-ski portion 63 of the hull, so that the skis and hull present in effect a single composite planing surface for low speed planing action.

To the rear ends of skis 12*a*, there are mounted a pair of lateral control flaps 13*a* similar to flaps 13 of FIGS. 1 to 7, with the connection between each ski and its corresponding flap being formed by a hinge 58*a* whose axis 59*a* is disposed essentially transversely of the longitudinal front to rear axis of the boat. A motor or other actuating unit 61*a* carried within each ski 12*a* is adapted to power actuate the corresponding flap downwardly and upwardly about its axis 59*a*, through a drive mechanism diagrammatically represented at 60*a*. As in the first form of the invention, motors 61*a* may be controlled electrically or otherwise from the pilot station, by a control 62*a*, and are desirably separately actuable, and also actuable by a single control simultaneously but in differential relation.

At low speeds, the skis 12*a* are in their lowermost positions of FIG. 8, so that the undersurfaces of the skis 12*a* and flaps 13*a* form with the undersurface 64 of mono-ski portion 63 of the hull a composite relatively wide under planing surface, which has a large wetted area and can therefore afford substantial lift to the vessel at low speeds. As the vessel picks up speed and rises in the water, it ultimately reaches a speed at which skis 12*a* may be raised to their full line positions of FIG. 8, leaving only the under planing surface 64 of the hull for contact with the water, while the skis 12*a* are out of the water. Thus, a greatly reduced wetted area is presented to the water, with high load alleviation and minimum response to contact with waves. Under these high speed conditions, lateral stability is maintained by actuating flaps 13*a* downwardly and upwardly to produce whatever roll counteracting forces may be necessary to maintain a properly horizontally oriented condition. The flaps in their downwardly and rearwardly inclined positions may be actuated far enough to actually contact the surface of the water and produce upward force against the boat at the flap locations, or may be actuated to intermediate positions in which the flaps will engage and be acted against by spray which may be produced at the undersurface of the skis and flaps by the high speed motion of the boat.

FIG. 11 shows a variational arrangement which may be considered as identical to that of FIGS. 1 to 7 except for the manner of mounting of the skis 12*b*, which in this case have their forward ends hinged directly to hull 11*b* at 73, to swing downwardly about a transverse horizontal axis rather than being mounted by a link as shown at 35 in FIG. 2. The rear portions of the skis 12*b* in FIG. 11 are power actuated by a piston and cylinder mechanism 41*b*, which may typically act through a toggle mechanism 74 whose arms 75 and 76 are pivoted to one another at 77 and to the hull and ski respectively at 78 and 79. As in the first form of the invention, each of the skis 12*b* carries a flap 13*b*, which is pivoted to the underside of the ski by a hinge 58*b* to swing about a transverse axis between the upper full line retracted position of FIG. 11 and the downwardly and rearwardly inclined broken line position of that figure. The vessel has the same two high and low speed planing modes discussed in connection with FIGS. 1 to 7, and in either of those planing modes the flaps 13*b* are controllable to counteract roll forces and maintain lateral stability of the craft.

In FIG. 8, the planing undersurface 64 of the hull is illustrated as having a slightly V-shaped transverse section, and the undersurfaces 80 of the side portions of the hull as well as the skis themselves and carried flaps 13*a* are also shown as disposed at slight transverse angularities or inclinations, to incline slightly upwardly as they advance laterally outwardly toward the opposite sides of the hull.

FIGS. 12 and 13 show another variational arrangement which is similar to that of FIG. 8, but in which the flaps 13*a* are omitted, and the planing undersurfaces do not have the above discussed lateral inclination. Rather, the planing undersurface 81 of the central mono-ski portion 82 of hull 11*c* in FIG. 12 is flat and substantially horizontal, as are the higher undersurfaces 83 formed on the hull at opposite sides of its mono-ski portion 82. The opposite sides of mono-ski portion 82 of the hull are defined by vertical walls 84, which are parallel to another and to the front to rear axis 85 of the craft, and which define with undersurfaces 83 two recesses 86 extending along opposite sides of the hull and within which two skis 12*c* are movably mounted. These skis may be mounted at their forward ends to the hull by hinges 86 for upward and downward swinging movement about a transverse axis 87 and between the upwardly retracted full line positions of FIG. 13 and the downwardly swung broken line positions of that figure.

Appropriate means are provided for power actuating skis 12*c* downwardly and upwardly relative to the hull, as by two vertical piston and cylinder mechanisms 88 having their cylinders connected to the hull and their pistons connected to the skis at 89. A control 90 in the pilot house of the boat is manually acutable to operate mechanisms 88 and the skis in unison between their full line positions, and can also operate these mechanisms and the two skis independently, to move either ski by itself to any desirable position within its range of upward and downward movement while the other ski is separately moved to any of its various positions. Thus, the skis themselves can be in this arrangement serve the lateral stabilizing purpose of the flaps 13, 13*a* and 13*b* of the other forms of the invention.

To propel the boat of FIGS. 12 and 13, a nozzle 91 emits a high velocity jet of water generally rearwardly, with the water being delivered by a pump 92 driven by an engine 93. The jet nozzle 91 is adjustable to emit the water in different directions for attaining a steering action, or to produce a forward jet if desired for reverse travel.

In using the boat of FIGS. 12 and 13 at low speed, the skis 12*c* are in their lowered broken line positions of FIG. 13, in which the horizontal planar undersurfaces 94 of the skis are aligned with and coplanar with one another and with the central planing undersurface 81 of the hull, to form a composite planing surface adapted to contact and skim along the upper surface of the water. This composite surface gives substantial lift to the craft at low planing speeds, ultimately raising the craft to a level at which skis 12*c* may be actuated upwardly in unison to their FIG. 12 full line retracted positions of reception adjacent the undersurfaces 83 of the hull. In this condition, the skis are out of contact with the water, and the only planing surface engaging the water is the undersurface 81 of the central mono-ski portion 82 of the hull, which of course has a small wetted area as compared with the initial composite ski and hull planing surface, with the same advantages discused in connection with the other forms of the invention. If one side of the vessel tends to roll or list downwardly while the skis are retracted upwardly to their full line positions, one of the skis may be actuated downwardly to any desired position, as to the broken line position of FIG. 12, to either contact the upper surface of the water or contact spray from the water passing along the underside of the ski, and by virtue of that contact produce an upward force against the ski tending to return that side of the craft upwardly. The positions of the two skis may thus be controlled continuously and individually to produce together whatever roll forces may be required at a particular instant to maintain lateral stability about the longitudinal axis of the craft. In this way, the normal tendency for a mono-ski type hull to have very poor lateral stability is overcome very effectively. This is particularly effective during maneuvering activities, especially in tight turns.

It is contemplated that the skis with which the present lateral control features are employed may be either of the buoyant or nonbuoyant type. FIGS. 14 and 15 show an arrangement in which the invention is applied to a pontoon type vessel, and in which the main hull 11*d* movably carries two pontoon type skis 12*d* at its opposite sides. These pontoons contain air chambers or other buoyant means giving the pontoons flotation characteristics. The pontoons are actuable upwardly and downwardly relative to hull 11*d* by mechanism represented at 95. If desired, the forward ends of the skis 12*d* can be pivotally mounted on the cabin extensions, as at 73*d*. Power units 22*d* corresponding to units 22 of FIG. 1 are provided on the pontoons 12*d* for emitting propulsion jets rearwardly therefrom. At the undersides of the after portions of the pontoons, there are provided a pair of flaps 13*d* which are hinged at their forward edges to the pontoons and are adapted to swing downwardly to inclined positions under the control of actuating mechanisms as heretofore discussed.

When the vessel of FIGS. 14 and 15 is traveling at low speed, the planing undersurfaces 96 of these ski-pontoons 12*d* are located relative to the planing undersurface 97 of the main hull (full line positions of FIG. 15) such as to enable all three of these surfaces to simultaneously contact and plane along the water and thus be additive in effect and produce a high lift force tending to raise the vessel at fairly slow speeds. When the speed reaches a predetermined value, the aft ends of the pontoons are actuated downwardly relative to the hull, as shown in FIG. 14, with the result that the entire weight of the vessel is supported on these pontoons as they plane along the upper surface of the water, and the main hull 11*d* and its surface 97 are elevated out of contact with the water. During both low and high speed conditions, flaps 13*d* may be actuated upwardly and downwardly relative to one another and as necessary to counteract roll forces and maintain lateral stability.

While certain specific embodiments of the present invention have been disclosed as typical, the invention is of course not limited to these particular forms, but rather is applicable broadly to all such variations as fall within the scope of the appended claims.

We claim:

1. A hydro-ski craft to be supported on and move along a body of water, comprising:

a hull;

two skis carried by said hull at locations spaced laterally apart;

means mounting said skis to said hull for upward and downward shifting movement relative thereto between upper retracted positions and lower extended positions;

said skis having planing under surfaces which, in at least one vertical setting of the skis, are positioned to contact and plane along the upper surface of said body of water;

flaps carried by said skis respectively for forward and downward movement therewith relative to said hull;

hinge means mounting said flaps at forward edges thereof to rearward portions of said skis respectively for movement therewith, and for movement relative thereto between first positions of extension downwardly and rearwardly from the skis and second higher positions said flaps being power actuatable differentially for controlling roll of said craft.

2. A hydro-ski craft as recited in claim 1, including control means for actuating said flaps differently with respect to their corresponding skis in a relation controlling roll of the craft.

3. A hydro-ski craft as recited in claim 1, including control means for actuating said two flaps relative to their respective skis in unison but essentially reversely to apply a controllable torque for providing roll control of the craft.

4. A hydro-ski craft as recited in claim 1, in which said flaps are movably connected to and extend rearwardly from trailing edges of said skis respectively.

5. A hydro-ski craft as recited in claim 1, in which said flaps have planing undersurfaces which in said higher positions thereof are substantially aligned with and form essentially continuations of said planing undersurfaces of said skis.

6. A hydro-ski craft as recited in claim 1, in which said last mentioned means include hinges connecting said flaps to said skis for downward and upward swinging movement relative thereto about axes extending generally transversely of the craft.

7. A hydro-ski craft as recited in claim 1, in which said hinge means connect said flaps to trailing edges of said skis respectively for downward and upward swinging movement relative to the skis about hinge axes extending generally transversely of the craft.

8. A hydro-ski craft as recited in claim 1, in which said hull has a planing undersurface which at a predetermined speed of the craft contacts and planes along the upper surface of said body of water, said skis in a predetermined vertical position thereof relative to the hull having their planing undersurfaces at a level corresponding approximately to said planing undersurface of the hull so that all three planing surfaces can engage and plane along the upper surface of the water simultaneously at the same speed, said skis in a different vertical position thereof having their planing undersurfaces offset vertically to a different level than said planing surface of the hull to provide a reduced planing area for increased speed of the craft.

9. A hydro-ski craft as recited in claim 8, in which said skis in said different position thereof are retracted upwardly to have their planing undersurfaces spaced above the level of said planing surface of the hull and leave only the latter for contact with the water surface at high speed.

10. A hydro-ski craft as recited in claim 9, in which said flaps are mounted to swing downwardly and upwardly relative to said skis in both said predetermined position and said different upwardly retracted position of the skis.

11. A hydro-ski craft as recited in claim 10, including control means for actuating said flaps differentially in both said predetermined position and said different upwardly retracted position thereof to apply a controlled torque providing controlled rolling motion of the craft.

12. A hydro-ski craft as recited in claim 1, in which said hull has a planing undersurface which at one speed of the craft contacts and planes along the upper surface of the body of water, said planing undersurfaces of said skis being located at approximately the same level as said planing undersurface of the hull in said upwardly retracted position of the skis, and being offset downwardly beneath the level of said planing undersurface of the hull in said extended position of the skis.

13. A hydro-ski craft as recited in claim 12, in which said last mentioned means of claim 1 include hinges mounting said flaps to rear portions of said skis to swing downwardly and upwardly relative thereto about generally transverse axes.

14. A hydro-ski craft comprising:

a hull having a planing undersurface adapted to engage and plane along the upper surface of a body of water;

two skis carried by said hull under and at opposite sides thereof and having planing undersurfaces; and means mounting said skis movably to said hull for upward and downward shifting movement relative thereto between a first position in which said planing undersurfaces of the skis are at a level to coact with said planing undersurface of the hull in supporting the craft, and a second upwardy retracted position in which said planing undersurfaces of the skis are sufficiently above the level of said planing undersurface of the hull to enable support of the craft by said planing undersurface of the hull independently of the skis at high speed.

15. A hydro-ski craft as recited in claim 14, including powered means for controllably actuating said skis between said two positions.

16. A hydro-ski craft comprising:

a hull;

means carried by the hull forming at least one downwardly facing planing surface adapted to engage and plane along the upper surface of a body of water;

two load alleviating stabilizing elements affixed beneath and at the forward end of said hull and movable relative thereto, spaced laterally apart and engageable downwardly against the surface of said body of water, or spray thereabove, when said planing surface is in planing contact with said surface of the water; and means for controllably moving said stabilizing elements upwardly and downwardly relative to said planing surface and relative to one another to vary the total planing surface area of said craft and to laterally stabilize the craft.

17. A hydro-ski craft as recited in claim 16, in which said stabilizing elements are two skis which are power actuable upwardly and downwardly in unison relative to said hull between upper and lower positions in a relation varying the effective wetted area of the craft, and are also actuable upwardly and downwardly relative to one another by said means to laterally control and stabilize the craft.

18. A hydro-ski craft as recited in claim 16, in which said stabilizing elements are hinged at forward ends thereof to swing between downwardly and rearwardly inclined lower positions and upper more horizontal positions.

19. A hydro-ski craft comprising:

a hull having a planing undersurface adapted to engage and plane along the upper surface of a body of water;

two skis carried by said hull at opposite sides thereof and having planing undersurfaces; and means mounting said skis movably and adjustably within recesses formed in the underside of said hull at opposite sides of and extending upwardly above the level of said planing undersurface of said hull for upward and downward shifting movement relative thereto between a first position in which said planing undersurfaces of the skis are at a level to coact with said planing undersurface of the hull in supporting the craft, and a second upwardly retracted position in which said planing undersurfaces of the skis are sufficiently above the level of said planing undersurface of the hull to enable support of the craft by said planing undersurface of the hull independently of the skis at high speed.

20. A hydro-ski craft as recited in claim 19, in which said planing undersurfaces of the hull and skis are essentially flat and closely adjacent one another and form essentially continuations of one another in said first position of the skis.

21. A hydro-ski craft comprising:

a hull;

two skis carried by the hull forming downwardly facing planing surfaces adapted to engage and plane along the upper surface of a body of water;

means for power actuating said skis upwardly and downwardly in unison relative to said hull to vary the effective wetted area of the craft;

two movable stabilizing flaps carried by said skis, spaced laterally apart and engageable downwardly against the surface of said body of water, or spray thereabove, when said planing surface is in planing contact with said surface of the water; and means for controllably moving said stabilizing flaps upwardly and downwardly in a swinging movement relative to said planing surfaces of said skis and relative to one another to vary the total planing surface area of said craft and to laterally stabilize the craft.

* * * * *